US008230623B2

(12) United States Patent
Patera

(10) Patent No.: US 8,230,623 B2
(45) Date of Patent: Jul. 31, 2012

(54) SNOW REMOVAL TOOL WITH CURVED SCOOP

(76) Inventor: David Patera, Columbia Falls, MT (US)

( * ) Notice: Subject to any disclaimer, the term of this patent is extended or adjusted under 35 U.S.C. 154(b) by 0 days.

(21) Appl. No.: 12/792,230

(22) Filed: Jun. 2, 2010

(65) Prior Publication Data

US 2011/0296718 A1 Dec. 8, 2011

(51) Int. Cl.
*E01H 5/02* (2006.01)

(52) U.S. Cl. ..... 37/265

(58) Field of Classification Search ..... 37/263, 37/265–285; 294/54.5, 55, 53.5, 57, 58
See application file for complete search history.

(56) References Cited

U.S. PATENT DOCUMENTS

| | | | | | |
|---|---|---|---|---|---|
| 258,260 | A * | 5/1882 | Staples | 37/265 |
| 542,867 | A * | 7/1895 | Wyman | 37/434 |
| 787,921 | A * | 4/1905 | Hooper | 37/265 |
| 1,445,952 | A * | 2/1923 | Hooper | 37/265 |
| 1,683,732 | A * | 9/1928 | Selin | 37/434 |
| 1,766,691 | A * | 6/1930 | Rugg | 37/265 |
| 2,256,953 | A * | 9/1941 | Smith | 37/280 |
| 2,752,701 | A * | 7/1956 | Whitcomb | 101/11 |
| 2,933,836 | A * | 4/1960 | McKinley | 37/265 |
| 3,007,263 | A * | 11/1961 | Lair | 37/241 |
| 3,017,710 | A * | 1/1962 | Carlson | 37/434 |
| 3,024,547 | A * | 3/1962 | Harrison | 37/403 |
| 3,154,336 | A * | 10/1964 | Nelson | 37/265 |
| 3,155,413 | A * | 11/1964 | Holombo | 37/265 |
| 3,343,807 | A * | 9/1967 | Moraski | 254/131.5 |
| 3,380,772 | A * | 4/1968 | Lissakers | 37/265 |
| 3,475,838 | A * | 11/1969 | Hagen et al. | 37/265 |
| 3,583,746 | A * | 6/1971 | Lissakers | 37/265 |
| 3,594,932 | A * | 7/1971 | Eriksson | 37/241 |
| 3,751,058 | A * | 8/1973 | Larsen | 280/30 |
| 3,923,331 | A * | 12/1975 | Hollnagel | 37/265 |
| 4,125,951 | A * | 11/1978 | Huerth | 37/265 |
| 4,161,073 | A * | 7/1979 | Oakes | 37/265 |
| 4,193,626 | A * | 3/1980 | Vondracek | 37/265 |
| 4,214,385 | A * | 7/1980 | Baranowski et al. | 37/434 |
| 4,245,411 | A * | 1/1981 | McMath | 37/265 |
| 4,248,466 | A * | 2/1981 | Carper | 37/265 |
| 4,253,257 | A * | 3/1981 | Albert | 37/197 |
| 4,607,872 | A * | 8/1986 | Herner | 294/54.5 |
| 5,039,151 | A * | 8/1991 | Davis | 294/54.5 |

(Continued)

FOREIGN PATENT DOCUMENTS

JP 61038012 A * 2/1986

*Primary Examiner* — Robert Pezzuto
(74) *Attorney, Agent, or Firm* — Anderson Gorecki & Manaras LLP

(57) ABSTRACT

A tool for manually moving snow and other loads includes a curved scoop having a leading edge and a trailing edge and a frame with handles attached to the curved scoop. The tool is balanced approximately midway between the leading edge and trailing edge when the scoop is loaded to facilitate adjustment of depth of cut and unloading. The scoop may also be temporarily deformed in response to manual application of torsional force via the handles in order to help accommodate unbalanced loads. A rope or cable can be connected to the handles. Wheels may be attached to the frame to facilitate movement over dry ground. Various removable edge members disposed on the leading edge of the scoop may be used depending on the material being loaded. Further, side panels attached to the frame may be used to enhance load capacity.

7 Claims, 4 Drawing Sheets

U.S. PATENT DOCUMENTS 5,048,883 A * 9/1991 Waluk ..... 294/54.5
5,056,245 A * 10/1991 Jenkins et al. ..... 37/265
5,197,772 A * 3/1993 Stecyk ..... 294/57
5,704,672 A * 1/1998 Sims ..... 294/58
5,887,919 A * 3/1999 Sallinen et al. ..... 294/54.5
6,735,887 B1 * 5/2004 Muzzammel ..... 37/285
D563,182 S * 3/2008 Kopp et al. ..... D8/10
2009/0184527 A1 * 7/2009 Marion ..... 294/54.5

* cited by examiner

SNOW REMOVAL TOOL WITH CURVED SCOOP

FIELD OF THE INVENTION

This invention is generally related to snow removal, and more particularly to a snow removal tool that requires less energy to move snow and facilitates loading a desired depth of snow.

BACKGROUND OF THE INVENTION

It is well known that manual removal of snow from driveways, walkways, roofs and other places is labor intensive. Perhaps the most widely used tool for manual snow removal is the snow shovel. Use of a snow shovel requires a significant effort because the snow is lifted off of the ground and thrown from the shovel. As a result, shoveling snow can result in lower back strain. A number of more ergonomic variants on the basic snow shovel design are known. However, the basic technique of lifting and throwing the snow has not changed significantly. Various hand plows for pushing snow along the ground are also known. Further, various large scoops for dragging a load of snow along the ground are known. However, these devices do not easily permit one to load snow at less than the full depth on a given surface. Further, the relatively great amount of surface area in contact with the ground tends to increase friction.

DETAILED DESCRIPTION

Figure 1:
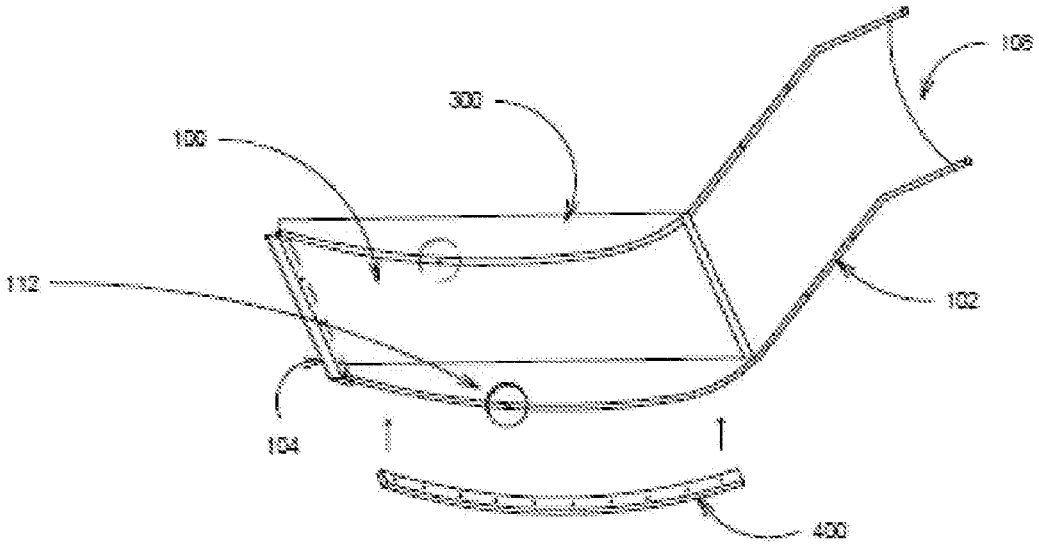
FIG. 1 is an isometric view of an improved snow removal tool characterized by a curved scoop.
Figure 2:
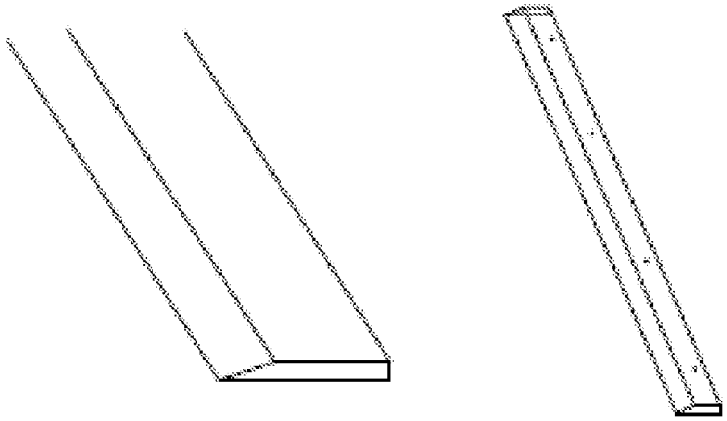
FIG. 2 illustrates a replaceable cutting edge of the snow removal tool.
Figure 3:
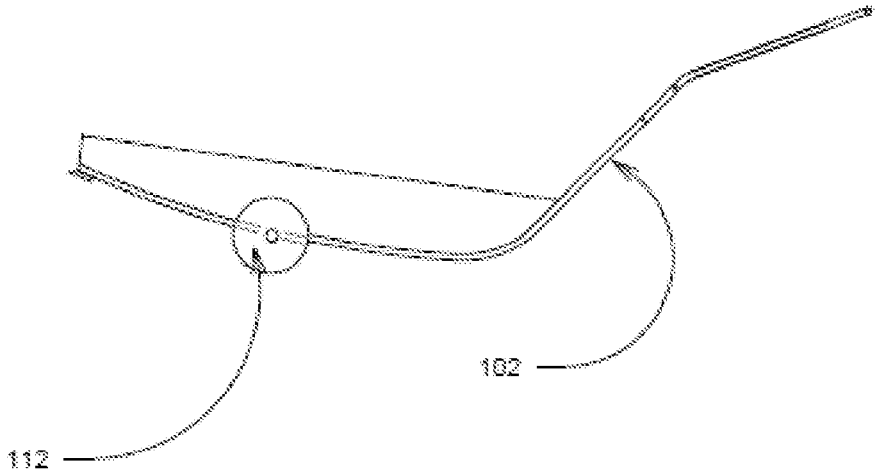
FIG. 3 is a side view of the snow removal tool.
Figure 4:
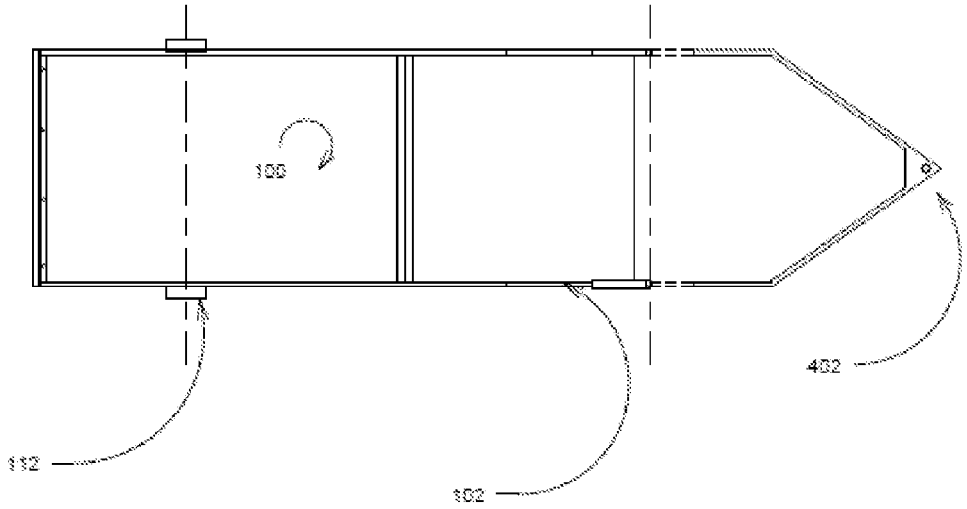
FIG. 4 is a plan view of the snow removal tool.

FIGS. 1 through 4 illustrate a manual snow moving tool. The tool includes a curved scoop 100 and tubular frame 102. The curvature of the scoop may be a section of a cylinder, elliptical cylinder or other shape. Further, the scoop may have a more complex shape including changes in concavity, e.g., as seen in one cycle of a wave of relatively longer period than amplitude. The scoop is constructed from one or more sections of sheet material such as metal, polycarbonate, fiberglass or other material. For example, 18 gauge sheet metal could be used for the entire scoop. Alternatively, the sheet metal may be attached to a lighter material, with the sheet metal functioning as the leading edge 104 of the scoop to facilitate cutting into the snow. The frame includes tubular members attached to three sides of the scoop, i.e., the three sides other than the leading edge. The tubular members on the sides of the scoop may extend upward and curve back to form handles. The height of the handles can be made adjustable by using two sections of tubing of different diameter such that one section can be inserted into the other sections and fixed in position with a pin or bolt. A rope or cable 108 connects the handles, and a lanyard may be attached to either a handle or the rope.

The invention has ergonomic advantages over prior art snow removal tools. For example, the curvature of the scoop 100 provides improved control over the depth of cut into the snow relative to flat scoops. In order to adjust the depth of cut the user adjusts the height of the leading edge of the scoop by applying force against the handles to cause the tool to pivot where the scoop contacts the ground, or snow-covered ground. Further, because the pivot point is close to the midway point between the leading and trailing edges the scoop can be pivoted with relatively little effort, even when loaded with snow. The ability to select depth of cut and more easily pivot the load is particularly advantageous when moving deep or wet snow. Small wheels 112 may be attached to the frame in order to facilitate movement across surfaces other than snow and ice.

The leading edge 104 of the scoop which cuts into the snow as it is loaded into the scoop may include a removable edge 200. The removable edge may be attached to the scoop by means of bolts, screws, clips or other fasteners. Alternatively the scoop and edge 200 may include interlocking features that permit the removable edge to be installed. Note that the edge may extend below the scoop in order to decrease abrasion of the scoop during use, e.g., due to contact with nail or screw heads. In this way the primary wear surfaces are replaceable, thereby extending the useful life of the tool. Various interchangeable edges might also be provided for different surfaces. For example, a plastic edge with a sloped lower surface that maintains separation between the leading edge and the surface from which snow is being removed may be favored for decks because the edge is less likely to catch on nail heads that might be encountered on a deck. Alternatively, a metals edge having little or no separation from the surface being cleaned may be preferable for driveways and walkways.

Side panels 300 may be used to enhance load carrying ability. The side panels may be either permanently of temporarily affixed. For example, the side panels may attach to the frame with clips. The sides clip-on sides increase capacity and allow function like a wheelbarrow. The use of side panels generally increases the load carrying capacity of the device by providing lateral support for the load. When used in combination with the wheels described above the side panels help to provide wheel-barrow-like functionality on various surfaces.

The scoop 100 is preferably deformable in response to application of unequal force via the handles, e.g., force in different directions. Because the scoop is constructed of sheet material, the scoop can typically be twisted in response to force applied via the handles. In order to avoid compromising such desirable characteristics with the frame, the tubular member attached to the trailing edge of the scoop may be attached to the other tubular frame members with hardware that permits the trailing edge member to freely twist relative to the other frame members. Alternatively, the trailing edge frame member may have a sufficiently low resistance to torsional force that it can be twisted with rigid attachments to the other frame members, and sufficient memory to return to a resting position when the torsional force is removed. Twisting the scoop helps to accommodate an unbalanced load of snow and also to more efficiently remove snow from an uneven surface.

The safety rope or cable 108 provides enhanced safety when removing snow from an inclined surface such as a roof. For removing snow from a roof the tool may be used, starting at the ridge, to scoop and push snow toward the bottom edge. The curved scoop and balanced pivot point also facilitate dumping the snow over the edge of the roof. Being tied off on the roof, the user simply stops before the roof edge and allows one hand or the other to take the cable and give it a slight tug if necessary to unload the snow quickly. The safety cable helps to prevent loss of the tool over a roofs edge, and also facilitates hands-free return of the tool to the roof ridge. An optional tow bar 402 may also be included.

Non-marring surfaces 400 may be attached to the frame. The non-marring surfaces may be constructed from high density plastic. The material should preferable resist cracking at the relatively low temperatures to which a snow removal tool might be subjected. When secured to the lower side of the frame, the non-marring surfaces help reduce the likelihood of scratching the surface from which snow is being removed. Further, the non-marring surfaces may reduce friction between the tool and the surface from which snow is being removed, thereby facilitating movement of the tool. It should also be noted that the non-marring surfaces protect fasteners which may be used to secure the scoop to the frame. For example, countersink holes may be formed in the plastic surface so that the head of the bolt, screw or rivet secures the plastic surface, frame and scoop together.

While the invention is described through the above exemplary embodiments, it will be understood by those of ordinary skill in the art that modifications and variations may be made without departing from the inventive concepts. Further, while the preferred embodiments are described in connection with various illustrative structures, one skilled in the art will recognize that the system may be embodied in connection with other structures. Accordingly, the invention should not be viewed as limited except by the scope and spirit of the appended claims.

What is claimed is:

1. Apparatus comprising:

a curved scoop having a leading edge, a first side, a second side, and a trailing edge; and a frame with first and second side support members attached to the curved scoop, a first handle at a distal end of the first side support member, and a second handle at a distal end of the second side support member, wherein the scoop is temporarily deformed in response to manual application of torsional force about an axis that intersects the first and second side support members, the torsional force applied via the handles to cause the leading edge to be parallel to a surface, and wherein curvature of the scoop defines a balance point midway between the leading edge and trailing edge when the scoop is loaded.

2. The apparatus of claim 1 further including a rope or cable connected to the handles for application of forward thrust.

3. The apparatus of claim 1 further including a lanyard.

4. The apparatus of claim 1 further including wheels attached to the frame such that the apparatus rests on the wheels and a portion of the scoop when unattended, and wherein the wheels are closer to the leading edge of the scoop than the portion of the scoop on which the apparatus rests when unattended.

5. The apparatus of claim 1 further including a low friction material disposed on the frame.

6. The apparatus of claim 1 further including a removable edge member disposed on the leading edge of the scoop.

7. The apparatus of claim 1 further including side panels attached to the frame.

* * * * *